US009033557B2

(12) United States Patent
Potucek et al.

(10) Patent No.: US 9,033,557 B2
(45) Date of Patent: May 19, 2015

(54) UNDERWATER LIGHT AND ASSOCIATED SYSTEMS AND METHODS

(71) Applicant: Hayward Industries, Inc., Elizabeth, NJ (US)

(72) Inventors: Kevin Potucek, Far Hills, NJ (US); James Carter, Warwick, RI (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 14/211,395

(22) Filed: Mar. 14, 2014

(65) Prior Publication Data

US 2014/0268824 A1 Sep. 18, 2014

Related U.S. Application Data

(60) Provisional application No. 61/792,307, filed on Mar. 15, 2013.

(51) Int. Cl.

| | |
|---|---|
| ***F21V 15/00*** | (2006.01) |
| ***F21V 21/04*** | (2006.01) |
| ***F21S 8/02*** | (2006.01) |
| *F21W 131/401* | (2006.01) |

(52) U.S. Cl.

CPC ..... *F21V 21/047* (2013.01); *F21S 8/02* (2013.01); *Y10T 29/49947* (2015.01); *F21V 21/04* (2013.01); *F21W 2131/401* (2013.01)

(58) Field of Classification Search

CPC ..... F21S 8/02; F21S 8/022; F21S 8/024
USPC ..... 362/364–366
See application file for complete search history.

(56) References Cited

U.S. PATENT DOCUMENTS

| | | | | |
|---|---|---|---|---|
| 5,556,188 | A | 9/1996 | Poppenheimer | |
| 5,749,669 | A | 5/1998 | Ketteler | |
| 2011/0063831 | A1* | 3/2011 | Cook | 362/235 |
| 2011/0267834 | A1* | 11/2011 | Potucek et al. | 362/551 |

OTHER PUBLICATIONS

International Search Report of the International Searching Authority mailed on Jul. 15, 2014, issued in connection with International Application No. PCT/US/027646 (2 pages).
Written Opinion of the International Searching Authority mailed on Jul. 15, 2014, issued in connection with International Application No. PCT/US/027646 (6 pages).

* cited by examiner

*Primary Examiner* — Sean Gramling
(74) *Attorney, Agent, or Firm* — McCarter & English, LLP

(57) ABSTRACT

Embodiments are directed to underwater lights for attachment to a niche, the niche including a threaded hole. The underwater lights include a light body that defines a flange. The flange includes an elongated slot. The elongated slot is configured and dimensioned to receive a fastening element therethrough for securing the light body to the niche. The underwater lights can include a spacer through which the fastening element is inserted. Tabs of the spacer can be inserted into the elongated slot of the flange. The elongated slot is configured and dimensioned to receive the fastening element therethrough. The threaded hole is configured and dimensioned to receive the fastening element. A position of the light body relative to the niche is adjustable by translating the fastening element within the elongated slot. Embodiments are also directed to underwater light systems and associated methods.

13 Claims, 9 Drawing Sheets

UNDERWATER LIGHT AND ASSOCIATED SYSTEMS AND METHODS

CROSS-REFERENCE TO RELATED APPLICATIONS

The present application claims the benefit of a U.S. provisional patent application entitled "Underwater Light and Associated Systems and Methods" which was filed on Mar. 15, 2013, and assigned Ser. No. 61/792,307. The entire content of the foregoing provisional application is incorporated herein by reference.

TECHNICAL FIELD

The present disclosure relates to underwater lights and associated systems and methods and, more particularly, to underwater lights that are compatible with a variety of niche sizes.

BACKGROUND

Swimming pool lights are generally secured in niches located in the walls and/or floor of a swimming pool. For example, FIG. 1 shows a niche 100 generally used in the industry. Niche 100 typically includes a niche body 102 which defines a niche flange 104 to be positioned against the concrete wall and/or floor of the swimming pool. Niche 100 also includes a cavity 112 for receiving at least a portion of a light (not shown). For fastening a light to the niche 100, the niche includes a bracket 108 typically positioned at about a 12:00 o'clock position which includes a hole 110 with a female thread for receiving a pilot screw which passes through a hole at the 12:00 o'clock position on the light, thereby securing the light to the niche 100, Niche 100 also includes a vertical lip 106, e.g., a bottom lip, a bracket, a flange, and the like, at about a 6:00 o'clock position which captures and/or holds a bottom catch or bracket on the light. The combination of the pilot screw and the bottom catch on the light secure the light in position relative to the niche 100.

For example, FIG. 2 shows a swimming pool light 150. The light 150 includes a lens 152, a light body 154 (e.g., a bezel), a flange 156 defined by the light body 154, and a rear housing 158. The flange 156 defines a bottom catch 162 (or bracket) for securing the light 150 into a niche 100. The flange 156 includes a screw hole 160 at a 12:00 o'clock position for securing the light 150 to the hole 110 of the niche 100. As described above, to secure the light 150 to the niche 100 of FIG. 1, the bottom catch 162 of the flange 156 can be inserted into the cavity 112 behind the vertical lip 106 such that the flange 156 is positioned directly behind the vertical lip 106. The flange 156 can further be positioned such that the flange 156 is directly in front of the hole 110 of the niche 100. The screw hole 158 can then receive a screw therein and the screw can be fixated to the threaded hole 110 of the niche 100. The light 150 is thereby secured within the niche 100 and prevented from unwanted detachment from the niche 100.

As is known in the industry, the spacing, e.g., spread, between the niche screw hole 110 and the vertical lip 106 can vary depending on which manufacturer fabricated the niche 100. The spread is shown in FIG. 1 as distance $D_1$. Matching the screw and bottom catch 162 spread on the light 150 to the threaded screw hole 110 and vertical lip 106 on the niche 100 can be important for properly securing the light 150 in the niche 100. The size of the light 150 and, in particular, the location of the screw hole 160 must therefore match the spread of the niche 100. The single-position screw hole 158 used in the industry, e.g., a round hole, is configured to receive a screw in one position only for matching the position of the hole 110 of the niche 100 and does not allow a variation of the position of the screw to match an incorrectly or differently sized niche 100. If the spread distance $D_1$ is not properly matched and/or if the spread distance $D_1$ varies uncontrollably, the buoyant light 150 can float upwards, thus allowing the bottom catch 162 of the light 150 to travel above and off the vertical lip 106 of the niche 100. This travel of the light 150 above and off the vertical lip 106 can present a hazard to those using the swimming pool.

Thus, despite efforts to date, a need remains for underwater lights which are compatible with different niche sizes. These and other needs are met by the exemplary underwater lights and associated systems and methods discussed herein.

SUMMARY

In accordance with embodiments of the present disclosure, exemplary underwater lights for a niche including a threaded hole are provided that include a light body that defines a flange. The flange includes an elongated slot. The elongated slot can be configured and dimensioned to receive a fastening element, e.g., a screw, therethrough for securing the light body relative to the niche. The threaded hole of the niche can be configured to receive the fastening element. The light body can be conformed for varying niche sizes or configurations by adjusting a position of the fastening element within the elongated slot.

The light body includes at least two brackets configured and dimensioned to facilitate installation of the underwater light in different niche sizes. The elongated slot extends through the flange of the light body. The elongated slot defines an elongated path along which the fastening element can travel to adjust the position of the fastening element relative to the threaded hole of the niche.

In some embodiments, the underwater lights include a spacer. The spacer can limit a travel distance of the fastening element within the elongated slot. In some embodiments, the spacer can be positioned between walls of the flange surrounding the elongated slot and the fastening element. The spacer includes a spacer body and tabs extending from the spacer body. The elongated slot can be configured to at least partially receive therethrough the tabs of the spacer. In some embodiments, the spacer includes protrusions on at least one of the spacer body and the tabs to create friction between the spacer and the elongated slot. In some embodiments. the flange includes a channel surrounding the elongated slot in which the spacer is slidably positioned.

In accordance with embodiments of the present disclosure, exemplary methods of installing an underwater light in a niche including a threaded hole are provided. The methods include providing a light body that defines a flange. The flange includes an elongated slot. The methods include providing a fastening element, e.g., a screw, for securing the light body relative to the niche. The elongated slot can be configured and dimensioned to receive the fastening element therethrough. The threaded hole can be configured and dimensioned to receive the fastening element. The exemplary methods include adjusting a position of the fastening element within the elongated slot to conform the light body for varying niche sizes or configurations.

In accordance with embodiments of the present disclosure, exemplary underwater light systems are provided that include a niche including a threaded hole and a light body that defines a flange. The flange includes an elongated slot. The elongated slot is configured and dimensioned to receive a fastening element, e.g., a screw, therethrough for securing the light body relative to the niche. The threaded hole can be configured to receive the fastening element. The light body can be conformed for varying niche sizes or configurations by adjusting a position of the fastening element within the elongated slot.

The niche can include a bracket configured and dimensioned for capturing a light bracket. The elongated slot defines an elongated path along which the fastening element can travel to adjust the position of the fastening element relative to the threaded hole of the niche. In some embodiments, the systems include a spacer. The spacer can limit a travel distance of the fastening element within the elongated slot. The spacer includes a spacer body and tabs extending from the spacer body. The elongated slot can be configured to at least partially receive therethrough the tabs of the spacer.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed underwater lights, reference is made to the accompanying figures, wherein.

DESCRIPTION OF EXEMPLARY EMBODIMENTS

Figure 3:
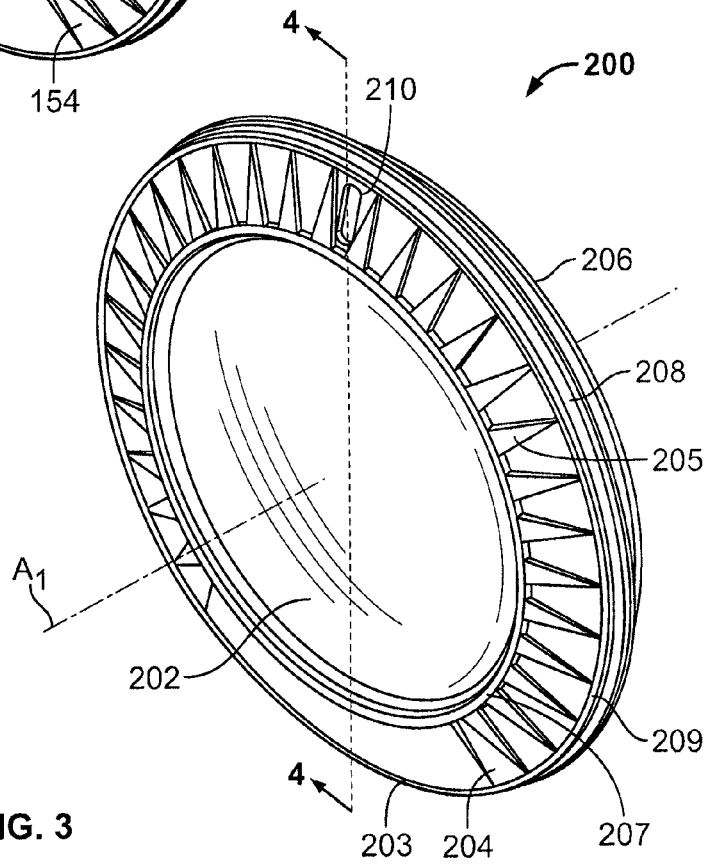
FIG. 3 is a perspective view of an underwater light of the present disclosure.

With reference to FIG. 3, a perspective view of an exemplary underwater light 200 (hereinafter "light 200") is provided. The underwater light 200 includes a lens 202, a light body 204, e.g., a bezel, and a rear housing 206 axially aligned along a central axis $A_1$. The light body 204 defines a flange 208 which circumferentially surrounds the lens 202 when the light body 204 and the lens 202 are assembled. The flange 208 of the light body 204 also extends beyond the diameter of the rear housing 206.

Figure 1:
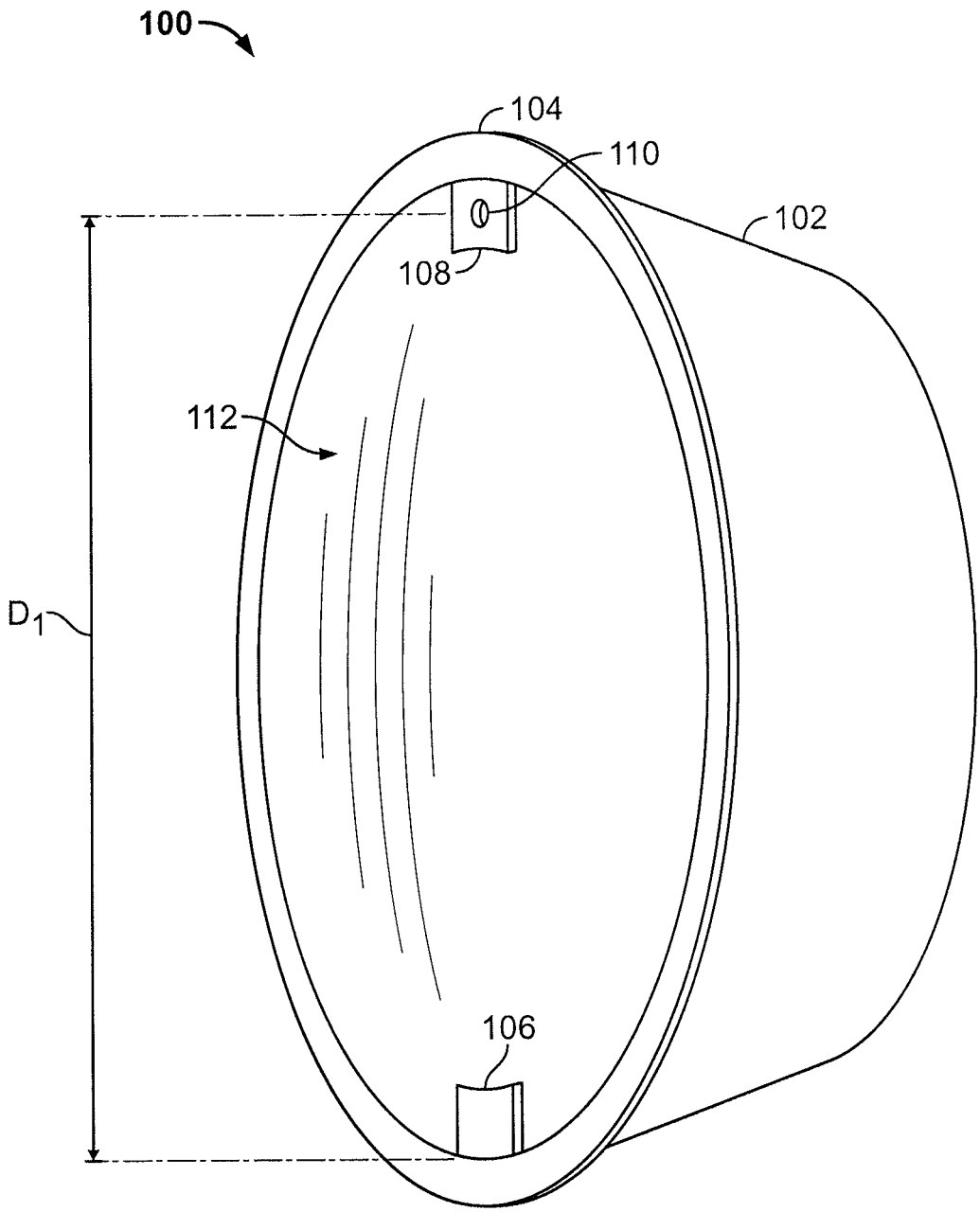
FIG. 1 (Prior Art)
FIG. 1 is a niche as taught by the prior art.

The flange 208 can be configured and dimensioned to be received by a vertical lip 106 of a niche 100 (see, e.g., FIG. 1). For example, the bottom catch 203 of the flange 208 circumferentially extending between an approximately 5 o'clock position and an approximately 7 o'clock position in a clockwise direction can be positioned behind the vertical lip 106 of the niche 100. In the embodiment shown in FIG. 3, the flange 208 can include a pattern of protrusions 205, e.g., decorations, extending circumferentially along the flange 208 between an approximately 7 o'clock position and an approximately 5 o'clock position in the clockwise direction, while the bottom catch 203 can be free of protrusions 205 to ensure a flush fit behind the vertical lip 106 of the niche 100. The protrusions 205 can extend axially from an inner edge 207 to an outer edge 209 of the flange 208. However, it should be understood that the protrusions 205 can circumferentially extend along the entire flange 208 and the bottom catch 203 can be formed between the protrusions 205.

The flange 208 includes an elongated slot 210 located at an approximately 12:00 o'clock position which is configured and dimensioned to receive a fastening element (not shown), e.g., a screw, therethrough. The elongated slot 210 can extend axially in a perpendicular direction relative to the central axis $A_1$. In addition, the elongated slot 210 can extend from the inner edge 207 to the outer edge 209 of the flange 208. The elongated slot 210 extends through the thickness of the flange 208 such that the screw can be used to secure the flange 208 to a threaded hole 110 in the bracket 108 of a niche 100. In particular, when inserted into the elongated slot 210, the screw can be positioned in multiple positions along the elongated slot 210 for matching the position of the threaded hole 110 of the niche 100 being fitted by sliding the screw along a path formed within the elongated slot 210. The light 200 can thereby be retrofitted to be compatible with a variety of niches 100 having different diameters and/or mounting configurations. For example, the light 200 can be retrofitted to be compatible with niches 100 having different spread distances $D_1$ (see, e.g., FIG. 1).

Figure 4:
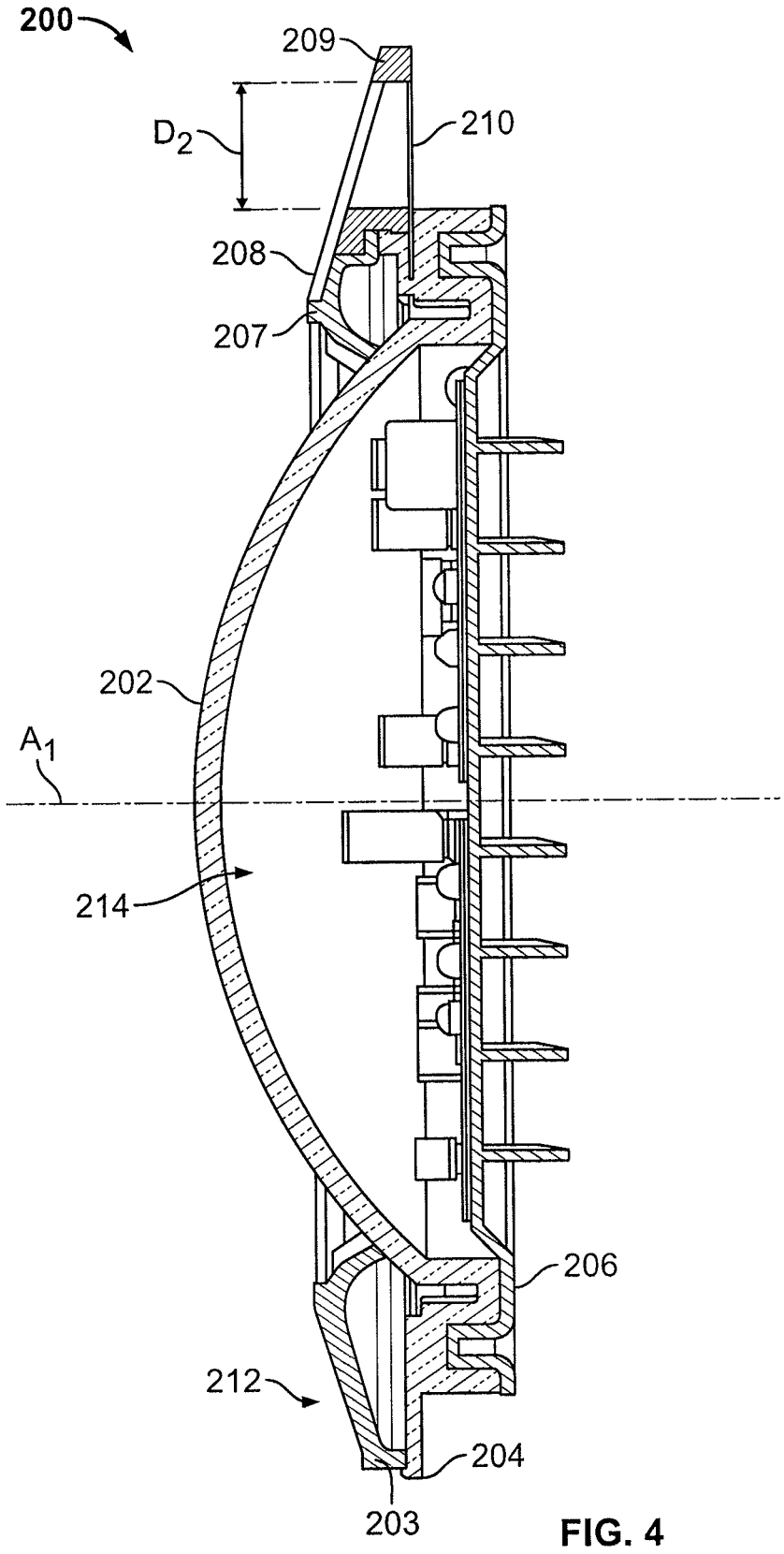
FIG. 4 is a cross-sectional view of an underwater light of the present disclosure.

FIG. 4 shows a cross-sectional view of an exemplary light 200 of FIG. 3. The light 200 generally includes a plurality of internal components 214, e.g., electrical components, a PCB, and the like, disposed behind the lens 202. For example, the internal components 214 can be fixated to the rear housing 206 and the rear housing 206 can be engaged with the lens 202 and/or the light body 204 such that the internal components 214 are disposed between the rear housing 206 and an inner surface of the lens 202. The front face 212 of the flange 208 at the 6:00 o'clock position, e.g., the bottom catch 203 or bracket, can be configured and dimensioned to be received by a vertical lip 106 of a niche 100. The front face 212 of the flange 208 includes one bottom catch 203 or bracket configuration. In some embodiments, the front face 212 of the flange 208 can include multiple bottom catches 203 or brackets molded into the flange 208 having different configurations and/or dimensions to facilitate the installation of the light 200 in different niches 100, e.g., niches having different diameters, different mounting configurations, and the like. In some embodiments, rather than the front face 212, the flange 208 can include at least one bottom catch 203 or bracket positioned behind the front face 212 of the flange 208 such that when the bottom catch 203 or bracket is fitted against the vertical lip 106 of a niche 100, the bottom catch 203 or bracket is covered from view or concealed by the flange 208, thereby providing a more aesthetic appearance.

Figure 2:
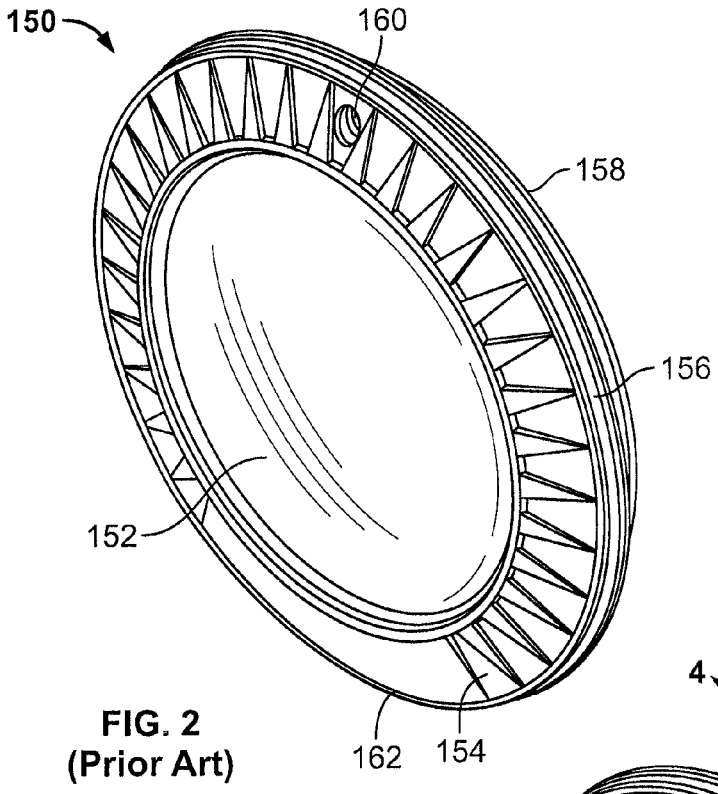
FIG. 2 (Prior Art)
FIG. 2 is an underwater light as taught by the prior art.

FIG. 4 further shows the elongated slot 210 of the flange 208. In particular, rather than having a single round screw hole 160 for receiving a screw (see, e.g., FIG. 2), the exemplary light 200 includes an elongated slot 210 defining an elongated screw travel distance $D_2$ or path. In some embodiments, the distance $D_2$ can be, e.g., approximately 0.5 inches, approximately 0.75 inches, approximately 1 inch, approximately 1.25 inches, approximately 1.5 inches, and the like. It should be understood that in some embodiments, the distance $D_2$ can be greater than or less than the exemplary distances provided herein, as long as the position of the screw within the elongated slot 210 can be adjusted. For example, a screw inserted into the elongated slot 210 can be translated within the elongated slot 210 in a direction substantially perpendicular to the central axis $A_1$ to accommodate different spread distances $D_1$ of a niche 100. In particular, the position of the screw within the elongated slot 210 can be adjusted to match the threaded hole 110 in the bracket 108 of niches 100 having different configurations and/or diameters, thus conforming the light body 204 to varying niches 100.

Figure 5A:
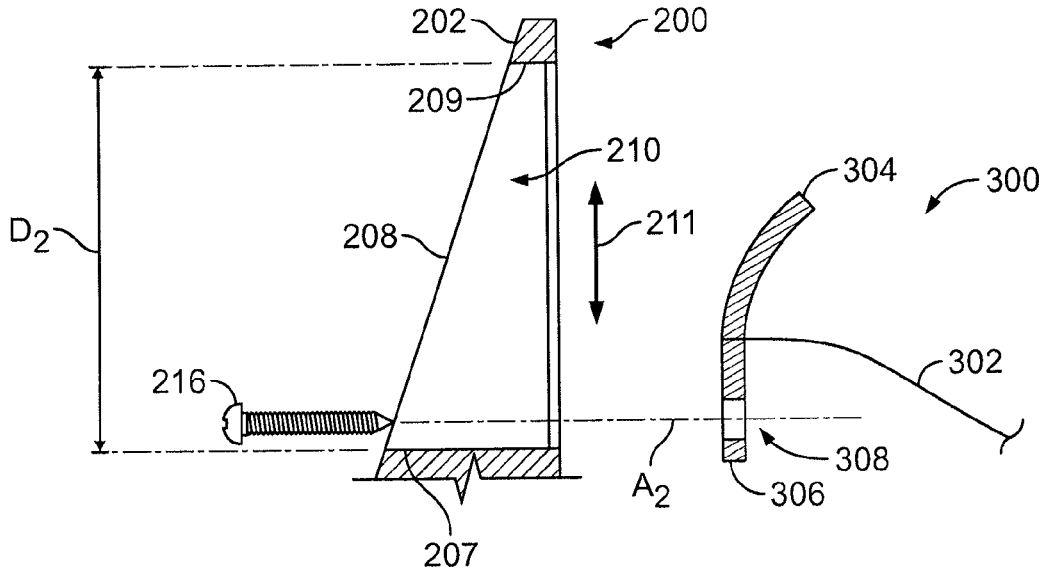
FIGS. 5A and 5B are detailed cross-sectional views of an elongated slot of an underwater light of the present disclosure.
Figure 5B:
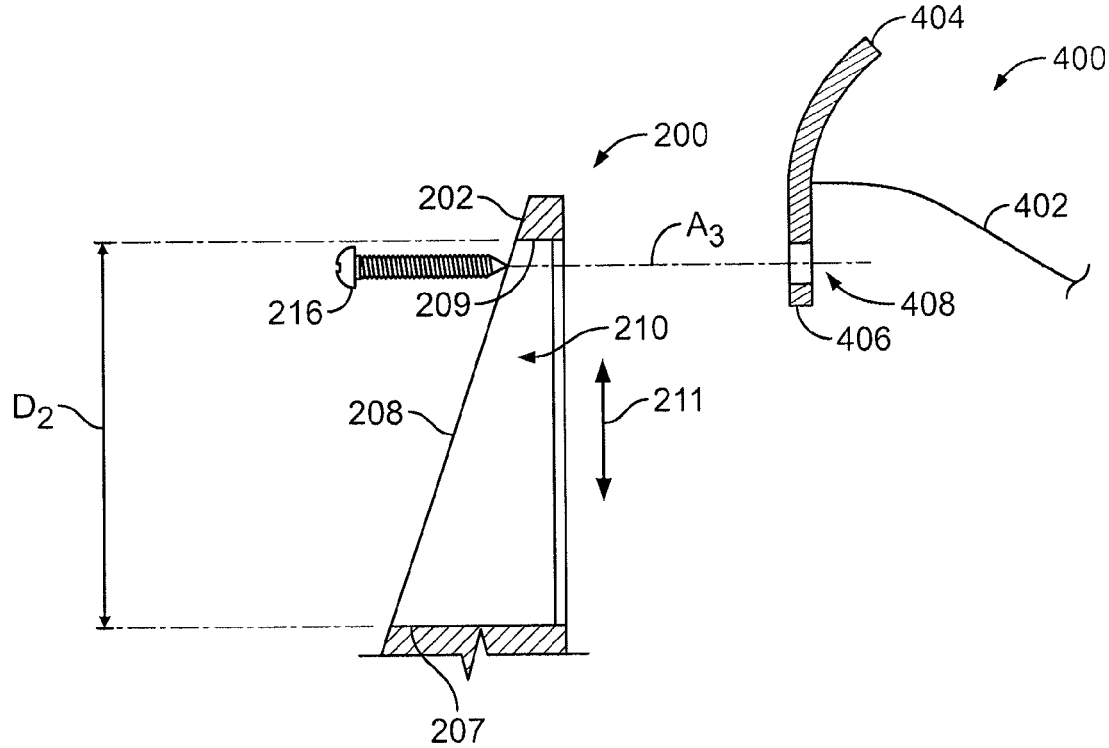

With reference to FIGS. 5A and 5B, detailed cross-sectional views of the elongated slot 210 relative to niches 300 and 400 of different sizes are shown. The niches 300, 400 shown in FIGS. 5A and 5B includes a niche body 302, 402, a niche flange 304, 404, a bracket 306, 406 located at an approximately 12:00 o'clock position of the niche 300, 400, and a hole 308, 408 including a female thread for receiving the screw 216, e.g., a fastening element, a pilot screw, and the like. Although described herein as having a bracket 306, 406 located at an approximately 12:00 o'clock position of the niche 300, 400, it should be understood that if the bracket 306, 406 is located in a different position, the light 200 can be rotated to align the screw 216 with the hole 308, 408. Similarly, although described herein as having a vertical lip at an approximately 6:00 o'clock position, if the niche 300, 400 includes a vertical lip in a different position, the light 200 can include multiple catches 203 or brackets circumferentially positioned around the perimeter of the flange 208 to be securely positioned behind the vertical lip. Niche 300 of FIG. 5A has a smaller diameter than niche 400 of FIG. 5B. However, as described above, the variable position of the screw 216 within the elongated slot 210 allows the mounting position of the exemplary light 200 to be adjusted relative to the niche 300, 400 such that the light 200 can be compatible with different niche 300, 400 sizes and/or configurations. It is further noted that the screw 216 could be captured in the slot 210 in any suitable manner, e.g., by way of a corresponding grommet to which the screw 216 is attached, so that the screw is not lost when the light 200 is removed from a niche.

For example, with reference to FIG. 5A, the light 200 can be secured to the niche 300 having a smaller diameter than the niche 400 by adjusting the position of the screw 216 within the elongated slot 210 to match the position of the threaded hole 308 in the bracket 306. In particular, the screw 216 can be slid within the elongated slot 210 along a direction substantially perpendicular to the central axis $A_1$ of the light 200 as represented by arrows 211. For example, the screw 216 can be moved to the lowest portion of the elongated slot 210 adjacent to the inner edge 207 to align the screw 216 with a central axis $A_2$ of the threaded hole 308, while maintaining the flange 208 secured within the vertical lip (not shown) of the niche 300. After the desired alignment between the screw 216 and the threaded hole 308 has been achieved, the light 200 can be secured to the niche 300.

With reference to FIG. 5B, the light 200 can be secured to the niche 400 having a greater diameter than niche 300 by adjusting the position of the screw 216 within the elongated slot 210 to match the position of the threaded hole 408 in the bracket 406. In particular, the screw 216 can be slid within the elongated slot 210 along a direction substantially perpendicular to the central axis $A_1$ of the light 200 as represented by arrows 211. For example, the screw 216 can be moved to the highest portion of the elongated slot 210 adjacent to the outer edge 209 to align the screw 216 with a central axis $A_3$ of the threaded hole 408, while maintaining the flange 208 secured within the vertical lip (not shown) of the niche 400. After the desired alignment between the screw 216 and the threaded hole 408 has been achieved, the light 200 can be secured to the niche 400. Although described herein as being positioned at the highest or lowest portions of the elongated slot 210, it should be understood that the screw 216 can be positioned along any position of the screw travel distance $D_2$ to align the screw 216 with the threaded hole of niches having diameters dimensioned between the diameters of niches 300 and 400. As described above, in some embodiments, the flange 208 can include multiple catches 203 or brackets molded thereon (or integral with the flange 208) to accommodate different sizes and/or configurations of a vertical lip of a niche.

Figure 6:
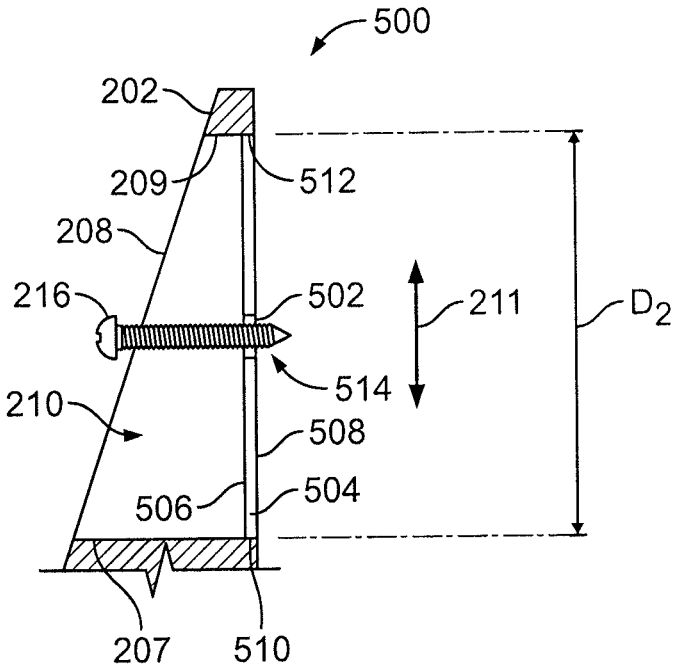
FIG. 6 is a detailed cross-sectional view of an elongated slot of an underwater light of the present disclosure including a first embodiment of a spacer.

FIG. 6 shows a detailed cross-sectional view of a second embodiment of an underwater light 500 (hereinafter "light 500"). It should be understood that the light 500 can be substantially similar in structure and function to the light 200 of FIGS. 3-5, except for the distinctions noted herein. Thus, like structural elements are marked with like reference characters. The light 500 includes a light body 202 defining a flange 208 which has an elongated slot 210 for receiving a screw 216 therein to secure the light 500 to a niche 100.

In the second embodiment of the light 500 shown in FIG. 6, the light 500 includes a first embodiment of a spacer 502 translatable within a channel 504, e.g., a track, formed in the wall of the elongated slot 210 of the flange 208. In particular, the inner walls of the elongated slot 210 can include the channel 504 formed by a front channel wall 506 and a rear channel wall 508 which extend between the inner edge 207 and the outer edge 209 of the flange 208. The front and rear channel walls 506, 508 can be positioned in a spaced relation relative to each other to form the channel 504 which is configured and dimensioned to receive the spacer 502. The spacer 502 can thereby travel, e.g., float, slide, and the like, within the channel 504 formed in the wall of the elongated slot 210 of the flange 208. In particular, the spacer 502 can travel within the channel 504 in a direction substantially perpendicular to the central axis $A_1$ as represented by arrows 211. In some embodiments, rather than being positioned within the wall of the elongated slot 210, the spacer 502 could be positioned adjacent to a rear wall of the flange 208 while still limiting travel of the spacer 502 relative to the distance $D_2$ of the elongated slot 210. Travel of the spacer 502 can be limited to the distance $D_2$ between a lowest position 510 aligned with the inner edge 207 of the flange 208 and a highest position 512 aligned with the outer edge 209 of the flange 208. The spacer 502 can thereby limit the screw travel distance $D_2$ between the inner and outer edges 207, 209 of the flange 208 to facilitate the installation of the light 500 against niches 100 having different ranges of spread distances $D_1$.

The spacer 502 includes a female threaded hole 514 for receiving the complementary. threads on the screw 216. Once the screw 216 has been at least partially threaded into the hole 514 of the spacer 502, the spacer 502 can prevent the screw 216 from falling out of the elongated slot 210 during installation of the light 500. If the screw travel distance $D_2$ in the elongated slot 210 is not limited, the buoyant light 500 could float upwards, thus allowing the bottom catch 203 or bracket of the light 500 to travel above and off the vertical lip 106, e.g., the bottom lip, of the niche 100. The spacer 502 thereby ensures that the bottom catch 203 or bracket of the flange 208 on the light 500 is firmly secured by the vertical lip 106 while aligning the screw 216 with the threaded hole 110 of the niche 100. The elongated slot 210, the spacer 502, and/or combinations thereof provide for a versatile yet properly limiting screw 216 position to facilitate varying the niche 100 spread distance $D_1$.

Figure 7:
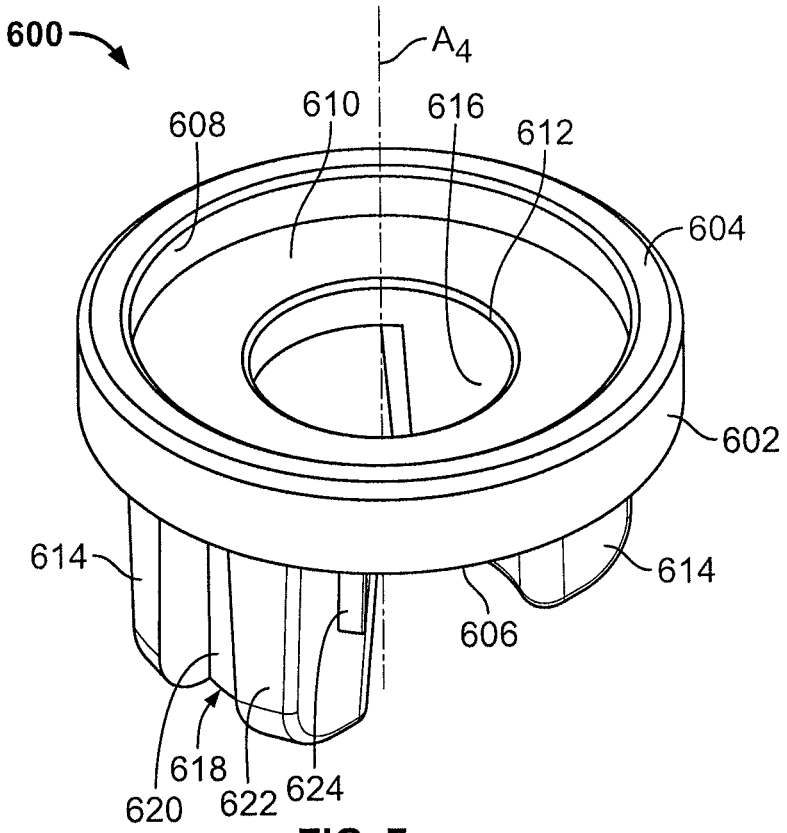
FIG. 7 is a top perspective view of a second embodiment of a spacer of the present disclosure.
Figure 8:
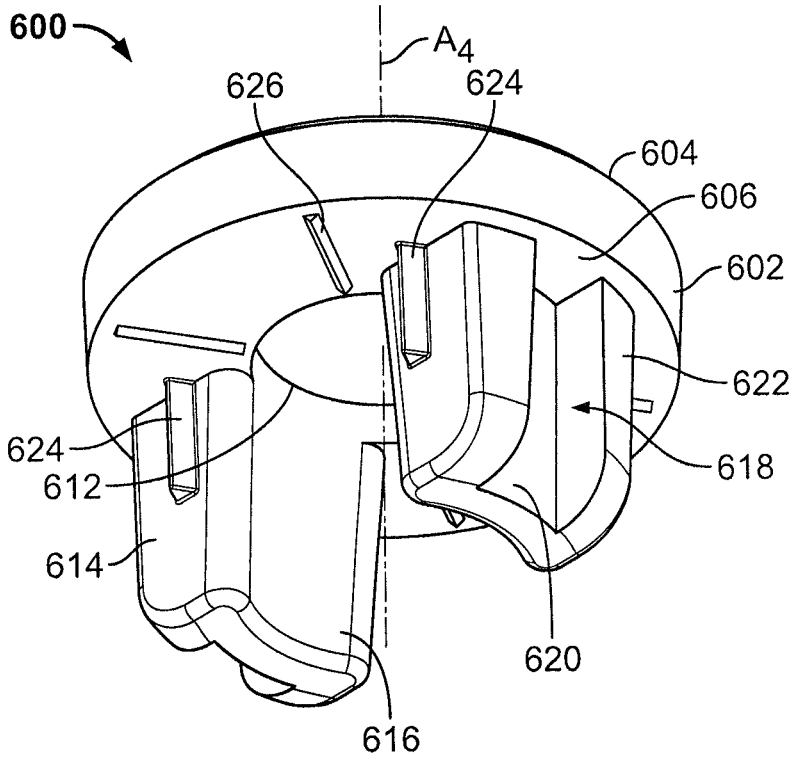
FIG. 8 is a bottom perspective view of a second embodiment of a spacer of the present disclosure.
Figure 9:
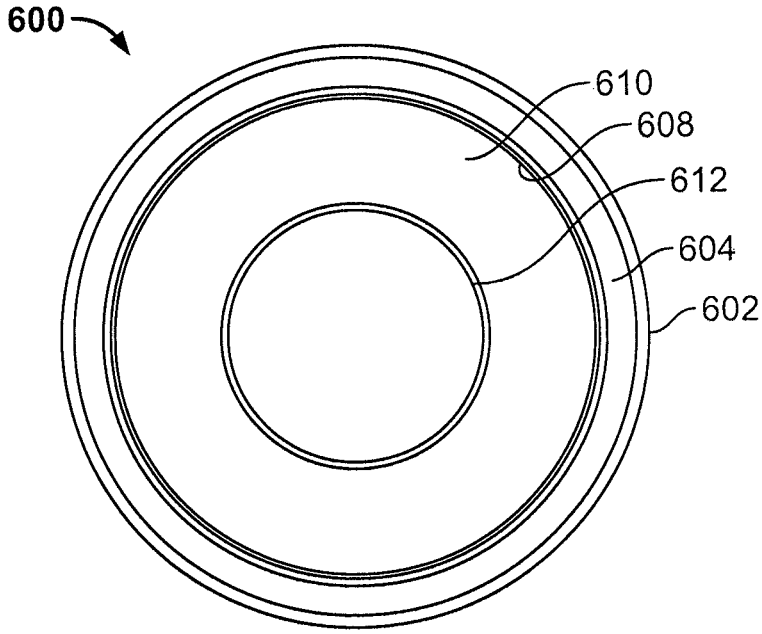
FIG. 9 is a top view of a second embodiment of a spacer of the present disclosure.
Figure 10:
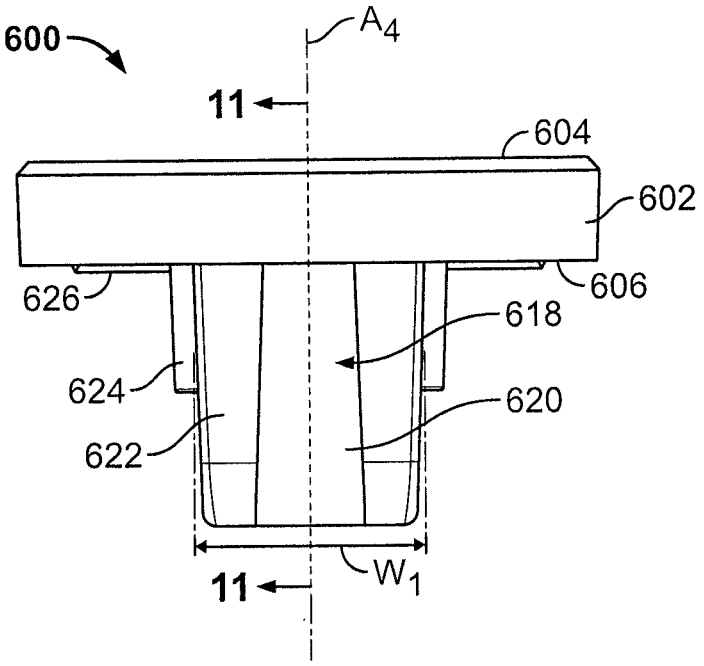
FIG. 10 is a side view of a second embodiment of a spacer of the present disclosure.
Figure 11:
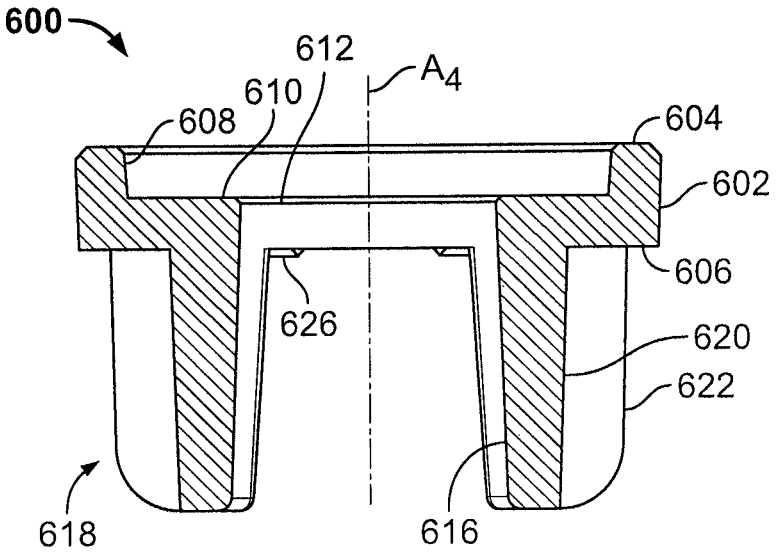
FIG. 11 is a cross-sectional view of a second embodiment of a spacer of the present disclosure.

FIGS. 7-11 are views of a second embodiment of a spacer 600, e.g., a stop washer, which can be implemented with the light 200, 500. The spacer 600 can be fabricated from plastic, metal, rubber, and the like. In particular, FIG. 7 is a top perspective view of the spacer 600, FIG. 8 is a bottom perspective view of the spacer 600, FIG. 9 is a top view of the spacer 600, FIG. 10 is a side view of the spacer 600 and FIG. 11 is a cross-sectional side view of the spacer 600. The spacer 600 includes a body 602 which defines a front surface 604 and a rear surface 606. Although shown as a circular body 602, in some embodiments, the body 602 of the spacer 600 can be configured as square, oval, rectangular, and the like. The front surface 604 can be defined by a ledge or protrusion 608 which extends circumferentially from and inner front surface 610 in a direction parallel to a central axis $A_4$. The spacer 600 further includes a hole 612 centrally positioned relative to the central axis $A_4$ and passing through the inner front surface 610. The hole 612 can be dimensioned to allow passage of the elongated portion of the screw, while retaining the head of the screw against the inner front surface 610. For example, the protrusion 608 can be dimensioned to receive and surround the head of the screw when the elongated portion of the screw has been passed through the hole 612.

In some embodiments, the spacer 600 can include at least two tabs 614 extending away from the rear surface 606 of the spacer 600 in a direction parallel to the central vertical axis $A_4$. The tabs 614 can extend from the rear surface 606 of the spacer 600 in an opposing relation relative to each other. In some embodiments, each tab 614 can circumferentially extend approximately 45 degrees around the central axis $A_4$. The width $W_1$ of the tabs 614 (see, e.g., FIG. 10) can be dimensioned such that the tabs 614 of the spacer 600 can pass and/or extend through the elongated slot 210 of the flange 208, while the rear surface 606 of the body 602 of the spacer 600 is positioned against the walls surrounding the elongated slot 210. The spacer 600 can thereby travel (slide) along the elongated slot 210 to position the screw and spacer 600 as desired.

An inner surface 616 of each tab 614 can define a concave surface to allow passage of the screw between the tabs 614. In some embodiments, the tabs 614 can be positioned such that the screw can be at least partially threaded into the tabs 614. Thus, when a screw has been passed through the hole 612, the tabs 614 can at least partially surround the elongated portion of the screw. In some embodiments, the inner surface 616 can substantially align with the hole 612. An outer surface 618 of each tab 614 can define a planar central region 620 and two protruding flanges 622 extending from the rear surface 606 of the body 602 to a distal end of the tab 614. In some embodiments, the side surfaces of each tab 614 can include protrusions 624, e.g., a textured surface, teeth, individual or stand-alone protrusions, and the like, which can provide friction between the tabs 614 and the elongated slot 210 to assist retention of the tabs 614 in the elongated slot 210. In some embodiments, the rear surface 606 of the body 602 can include protrusions 626, e.g., a textured surface, teeth, individual or stand-alone protrusions, and the like, which can provide friction between the rear surface 606 and the walls surrounding the elongated slot 210 when the rear surface 606 is positioned against the walls surrounding the elongated slot 210. In some embodiments, the protrusions 626 can define a plurality of individual or stand-alone teeth which extend axially away from and are circumferentially spaced about the central axis $A_4$.

Figure 12:
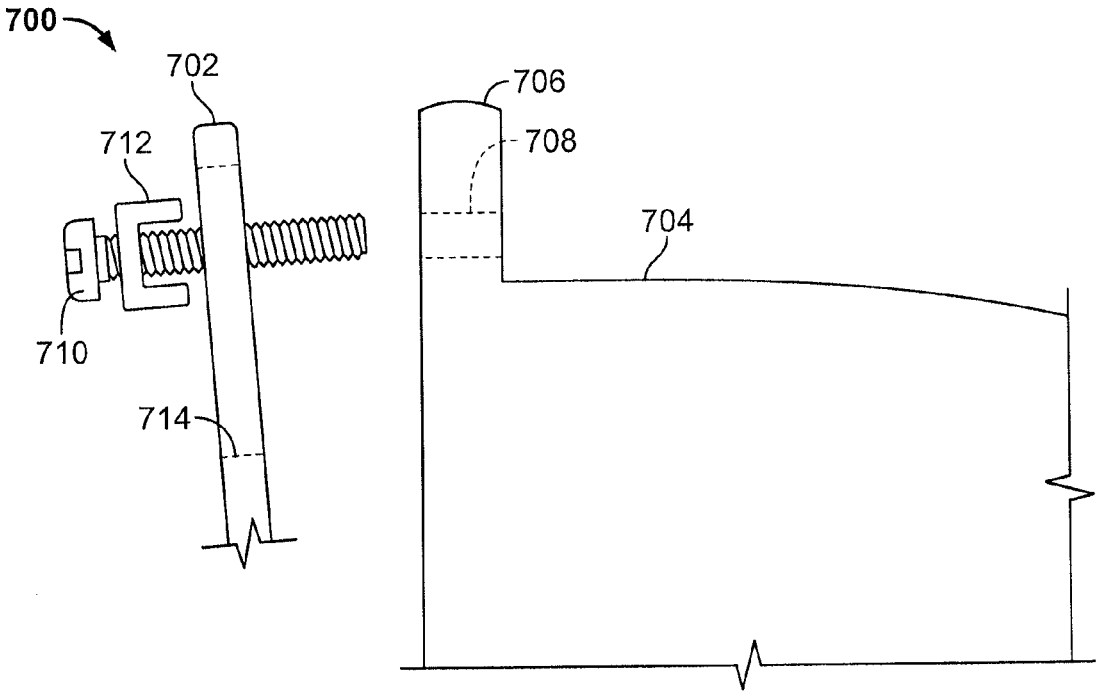
FIG. 12 is a detailed side view of an underwater light of the present disclosure including a second embodiment of a spacer.

FIG. 12 shows a diagrammatic view of an underwater light 702 and a niche 704 assembly 700. The niche 704 includes a flange 706 extending therefrom including a hole 708 into which the screw 710 can be threaded. The spacer 714, e.g., the spacer 600 discussed above, can be positioned around the elongated portion of the screw 710 and the elongated portion of the screw 710 can be inserted into the elongated slot 714 of the flange of the underwater light 702. The screw 710 can further be aligned with the hole 708 of the flange 706 in the niche 704 and then threaded into the hole 708 while maintaining a separation between the head of the screw 710 and the underwater light 702 with the spacer 600. Maintaining a separation between these components can reduce damage to the underwater light 702 and/or the flange 706 due to over-tightening of the screw 710, etc.

Figure 13:
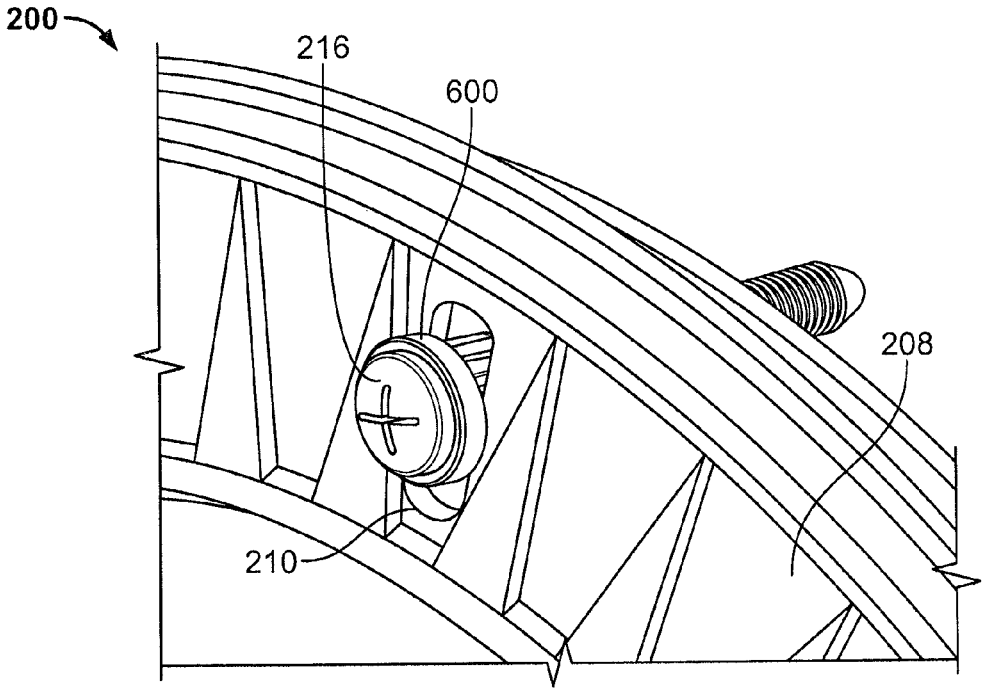
FIG. 13 is a detailed perspective view of an underwater light of the present disclosure including a second embodiment of a spacer.
Figure 14:
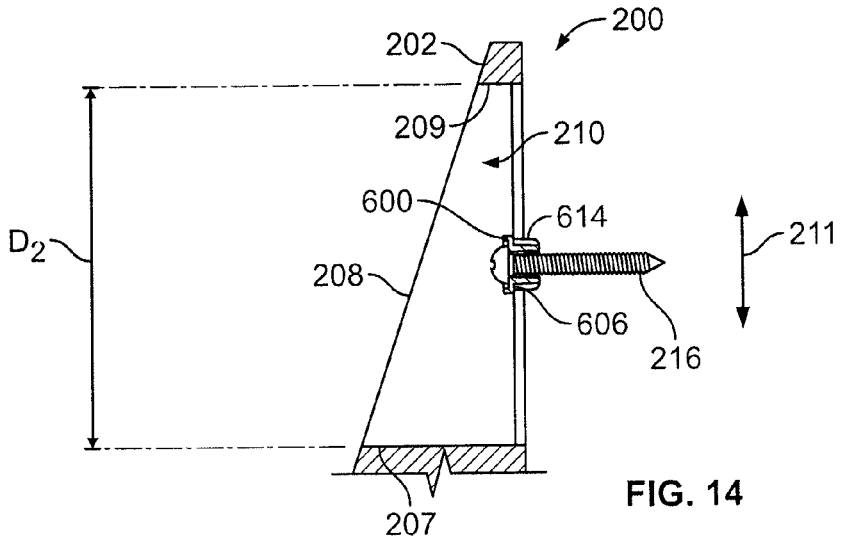
FIG. 14 is a detailed cross-sectional view of an underwater light of the present disclosure including a second embodiment of a spacer.

FIGS. 13 and 14 show the light 200 with the second embodiment of the spacer 600. In particular, FIG. 13 shows a detailed perspective view of the light 200 with the spacer 600 and FIG. 14 shows a detailed cross-sectional view of the light 200 with the spacer 600. As can be seen from FIGS. 13 and 14, and as discussed above, when assembled with the light 200, the tabs 614 of the spacer 600 can extend through the elongated slot 210 while the rear surface 606 is positioned against the walls surrounding the elongated slot 210. For example, the tabs 614 of the spacer 600 can be detachably snapped into the elongated slot 210 and a position of the spacer 600 can be adjusted in the position indicated by arrows 211 to align the spacer 600 relative to a hole in a flange of a niche (not shown).

In some embodiments, the spacer 600 can be incorporated into the light 500 of FIG. 6. For example, rather than implementing a spacer 502, the portion of the body 602 of the spacer 600 extending beyond the tabs 614 can be positioned within the channel 504 such that the spacer 600 can travel within the channel 504 and cannot be removed from the light 500. The spacer 600 can thereby be captured in the channel 504 and can float within the channel 504 to permit alignment of the spacer 600 with different sizes of niches, while the tabs 614 of the spacer 600 extend through the elongated slot 210.

Figure 15:
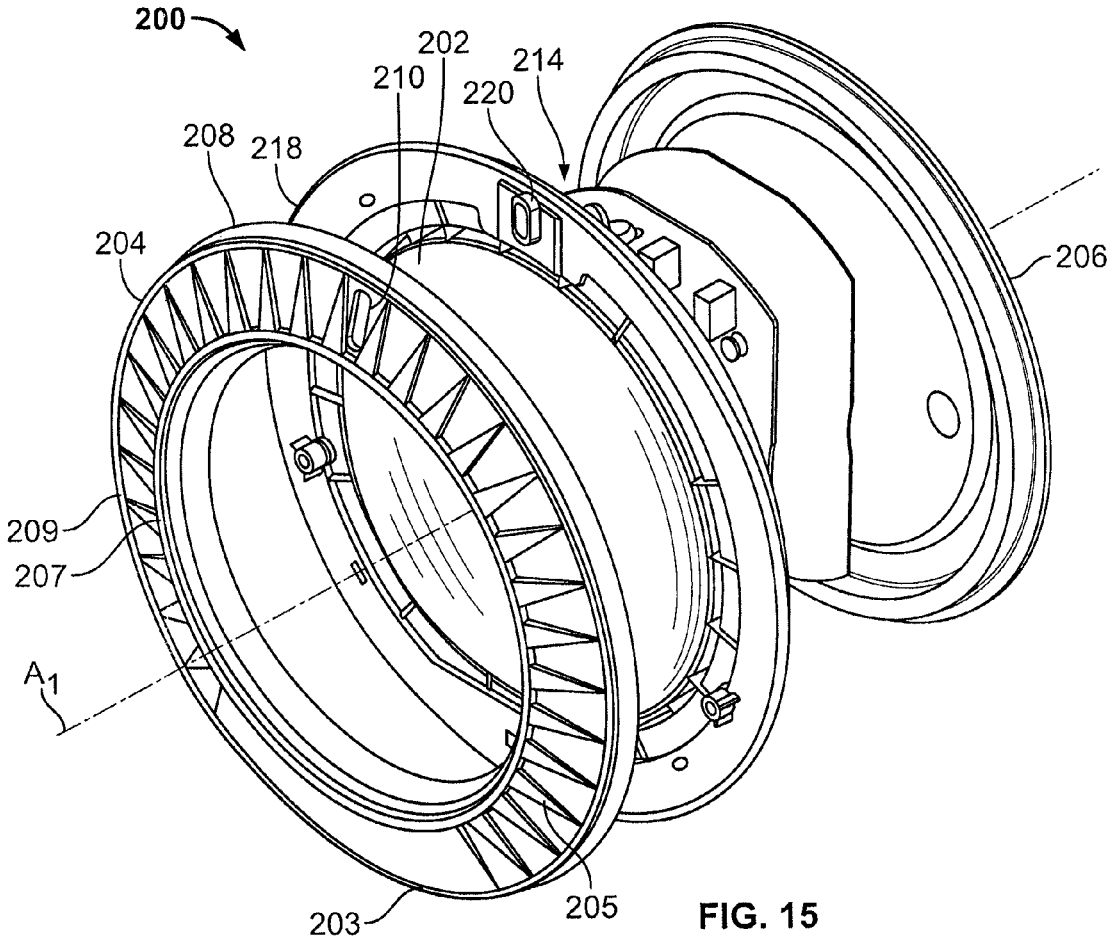
FIG. 15 is an exploded view of an underwater light of the present disclosure.

FIG. 15 is an exploded perspective view of the light 200 of FIG. 3. The light 200 includes a light body 204, a rear housing 206 and a plurality of internal components 214, e.g., electrical components, a PCB, and the like. The light 200 can also include a lens housing 218 for securing the lens 202 between the light body 204 and the rear housing 206. In embodiments that include the lens housing 218, an elongated lens housing slot 220 can be provided complementary to the elongated slot 210 of the flange 208 such that a position of the screw inserted into the elongated slot 210 can be varied by sliding the screw along the permissible vertical distance of the elongated lens housing slot 220 and the elongated slot 210. The flange 208 of the light 200 can thereby be positioned behind the vertical lip 106 of the niche 100 and the position of the screw 216 relative to the threaded hole 110 of the niche 100 can be adjusted to conform the light 200 to a variety of niche 100 sizes and/or configurations. The risk of the buoyant light 200 rising above and out of the vertical lip 106 of the niche 100 can thereby be minimized by ensuring that the light 200 can be securely fastened within the niche 100. Therefore, as discussed herein, the underwater lights, with or without the spacers, advantageously facilitate installation of the underwater lights in different niche sizes.

While embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. An underwater light for attachment to a niche, the niche including a threaded hole, the underwater light comprising:

a light body that defines a flange, the flange including an elongated slot, the elongated slot being configured and dimensioned to receive a fastening element and a spacer therethrough for securing the light body relative to the niche, the spacer limiting a travel distance of the fastening element within the elongated slot, wherein the elongated slot is configured to at least partially receive therethrough at least a portion of the spacer such that the spacer can travel along the elongated slot to a desired location, wherein the threaded hole is configured to receive the fastening element, and wherein the light body is adjustable to accommodate varying niche sizes or configurations by adjusting a position of the fastening element and the spacer within the elongated slot.

2. The underwater light of claim 1, wherein the light body comprises at least two brackets configured and dimensioned to facilitate installation of the underwater light in different niche sizes.

3. The underwater light of claim 1, wherein the elongated slot extends through the flange of the light body.

4. The underwater light of claim 1, wherein the elongated slot defines an elongated path along which the fastening element can travel to adjust the position of the fastening element relative to the threaded hole of the niche.

5. The underwater light of claim 1, wherein the spacer is positioned between walls of the flange surrounding the elongated slot and the fastening element.

6. The underwater light of claim 1, wherein the spacer comprises protrusions for creating friction between the spacer and the elongated slot.

7. The underwater light of claim 1, wherein the flange includes a channel surrounding the elongated slot in which the spacer is slidably positioned.

8. A method of installing an underwater light in a niche, the niche including a threaded hole, the method comprising:

providing a light body that defines a flange, the flange including an elongated slot, providing a fastening element for securing the light body relative to the niche, the elongated slot being configured and dimensioned to receive the fastening element and a spacer therethrough, and the threaded hole being configured to receive the fastening element, positioning the spacer between the fastening element and walls of the flange surrounding the elongated slot, the spacer limiting a travel distance of the fastening element within the elongated slot, passing at least a portion of the spacer at least partially through the elongated slot, and adjusting a position of the fastening element and the spacer within the elongated slot to accommodate varying niche sizes or configurations.

9. The method of claim 8, comprising slidably positioning the spacer in a channel of the flange surrounding the elongated slot.

10. The method of claim 8, comprising moving the fastening element along an elongated path defined by the elongated slot to adjust the position of the fastening element relative to the threaded hole of the niche.

11. An underwater light system, comprising:

a niche including a threaded hole, a light body that defines a flange, the flange including an elongated slot, the elongated slot being configured and dimensioned to receive a fastening element and a spacer therethrough for securing the light body relative to the niche, the spacer limiting a travel distance of the fastening element within the elongated slot, wherein the threaded hole is configured to receive the fastening element, wherein the elongated slot is configured to at least partially receive therethrough at least a portion of the spacer such that the spacer can travel along the elongated slot to a desired location, and wherein the light body is adjustable to accommodate varying niche sizes or configurations by adjusting a position of the fastening element and the spacer within the elongated slot.

12. The underwater light system of claim 11, wherein the niche comprises a bracket configured and dimensioned for capturing a light bracket.

13. The underwater light system of claim 11, wherein the elongated slot defines an elongated path along which the fastening element can travel to adjust the position of the fastening element relative to the threaded hole of the niche.

* * * * *

UNITED STATES PATENT AND TRADEMARK OFFICE

CERTIFICATE OF CORRECTION

PATENT NO. : 9,033,557 B2
APPLICATION NO. : 14/211395
DATED : May 19, 2015
INVENTOR(S) : Kevin Potucek et al.

It is certified that error appears in the above-identified patent and that said Letters Patent is hereby corrected as shown below:

In The Specification

In Column 1, line 35, the "," should be deleted and replaced with a "."; and

In Column 7, line 25, the word "and" should be deleted and replaced with the word "an".

Signed and Sealed this
Seventeenth Day of May, 2016

Michelle K. Lee

Michelle K. Lee
*Director of the United States Patent and Trademark Office*